US011401641B2

(12) United States Patent
Oka et al.

(10) Patent No.: US 11,401,641 B2
(45) Date of Patent: Aug. 2, 2022

(54) SEWING MACHINE

(71) Applicant: BROTHER KOGYO KABUSHIKI KAISHA, Nagoya (JP)

(72) Inventors: Hidenori Oka, Tokai (JP); Mitsuhiro Iida, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/111,018

(22) Filed: Dec. 3, 2020

(65) Prior Publication Data

US 2021/0087729 A1 Mar. 25, 2021

Related U.S. Application Data

(63) Continuation of application No. PCT/JP2019/022715, filed on Jun. 7, 2019.

(30) Foreign Application Priority Data

Jul. 2, 2018 (JP) ..... JP2018-125933

(51) Int. Cl.
*D05B 19/08* (2006.01)
*D05B 79/00* (2006.01)

(52) U.S. Cl.
CPC ..... *D05B 19/085* (2013.01); *D05B 79/00* (2013.01); *D05D 2205/16* (2013.01)

(58) Field of Classification Search
CPC ..... D05B 19/085; D05B 77/00; D05B 79/00; D05B 73/00; D05B 73/02
See application file for complete search history.

(56) References Cited

U.S. PATENT DOCUMENTS 4,526,116 A * 7/1985 Ma/ nnel ..... G05B 19/4205 112/475.19
5,072,680 A 12/1991 Nakashima
(Continued)

FOREIGN PATENT DOCUMENTS

JP H03-234283 A 10/1991
JP H05-068760 A 3/1993
(Continued)

OTHER PUBLICATIONS

Jan. 5, 2021 International Preliminary Report on Patentability issued in International Patent Application No. PCT/JP2019/022715.
(Continued)

*Primary Examiner* — Danny Worrell
(74) *Attorney, Agent, or Firm* — Oliff PLC

(57) ABSTRACT

In a sewing machine, an arm includes, on one side thereof in a first direction, a head. A needle bar is disposed at the head to reciprocally move in a second direction. A feed mechanism feeds a workpiece from one side toward the other side of the head in a third direction. The projection unit disposed at the head projects a projection image toward a bed. The projection unit includes an emitter for projecting image light of the projection image. The photographing unit disposed at the head captures a photographing target. The photographing unit includes an incident portion on which light reflected by the photographing target is incident. The emitter and the incident portion are disposed further toward the one side of the arm in the first direction than the needle bar, and further toward the one side of the head in the third direction than the needle bar.

25 Claims, 13 Drawing Sheets

(56) References Cited

U.S. PATENT DOCUMENTS

| | | | | |
|---|---|---|---|---|
| 5,205,232 | A * | 4/1993 | Sadeh | A43D 119/00 112/475.03 |
| 5,323,722 | A * | 6/1994 | Goto | G05B 19/4205 112/102.5 |
| 6,263,815 | B1 * | 7/2001 | Furudate | D05B 7/00 112/470.13 |
| 8,061,286 | B2 * | 11/2011 | Hirata | D05C 5/04 112/470.01 |
| 8,463,420 | B2 * | 6/2013 | Tokura | D05B 19/12 112/475.19 |
| 11,060,221 | B2 * | 7/2021 | Minematsu | D05B 35/12 |
| 2011/0226170 | A1 * | 9/2011 | Tokura | D05C 13/02 112/470.05 |
| 2015/0233032 | A1 * | 8/2015 | Ota | D05C 7/04 112/470.05 |
| 2020/0048807 | A1 * | 2/2020 | Imaizumi | D05B 35/12 |
| 2020/0314081 | A1 * | 10/2020 | Yamamoto | D05B 79/00 |
| 2021/0087729 | A1 * | 3/2021 | Oka | D05B 79/00 |

FOREIGN PATENT DOCUMENTS

| | | | |
|---|---|---|---|
| JP | H10-323468 | A | 12/1998 |
| JP | 2011-194043 | A | 10/2011 |
| JP | 2014-136037 | A | 7/2014 |

OTHER PUBLICATIONS

Sep. 3, 2019 International Search Report issued International Patent Application No. PCT/JP2019/022715.

Jan. 4, 2022 Office Action issued in Japanese Patent Application No. 2018-125933.

* cited by examiner

SEWING MACHINE

CROSS-REFERENCE TO RELATED APPLICATION

This is a continuation application of International Application No. PCT/JP2019/022715 filed on Jun. 7, 2019 which claims priority from Japanese Patent Application No. 2018-125933 filed on Jul. 2, 2018. The entire contents of the earlier applications are incorporated herein by reference.

TECHNICAL FIELD

Aspects of the disclosure relate to a sewing machine.

BACKGROUND

A known sewing machine includes a projector as a projection unit, and an image sensor as a photographing unit. The projector projects a projection image onto a workpiece placed in the vicinity of a needle drop point. The image sensor captures a photographing range in the vicinity of the needle drop point.

SUMMARY

The projection unit is to be disposed at an appropriate position to properly project a projection image, downsize the projection unit, and realize operability of the sewing machine. The photographing unit is to be disposed at an appropriate position to properly capture a photographing target, securely provide a photographing area, and realize operability of the sewing machine.

Aspects of the disclosure provide a sewing machine enabling a projection unit to properly project a projection image and a photographing unit to properly capture a photographing target, while maintaining user operability.

According to one or more aspects of the disclosure, a sewing machine includes a bed, an arm, a feed mechanism, a projection unit, and a photographing unit. The arm extends in a first direction and includes, on one side thereof in the first direction, a head. The needle bar is disposed at the head and configured to receive a needle and reciprocally move in a second direction orthogonal to the first direction. The feed mechanism is configured to feed a workpiece, from one side toward the other side of the head, in a third direction orthogonal to the first direction and the second direction. The projection unit is disposed at the head and configured to project a projection image toward the bed. The projection unit includes an emitter from which image light of the projection image is emitted. The photographing unit is disposed at the head and configured to capture a photographing target. The photographing unit includes an incident portion on which light reflected by the photographing target is incident. The emitter of the projection unit and the incident portion of the photographing unit are disposed further toward the one side of the arm in the first direction than the needle bar, and further toward the one side of the head in the third direction than the needle bar.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Figure 1:
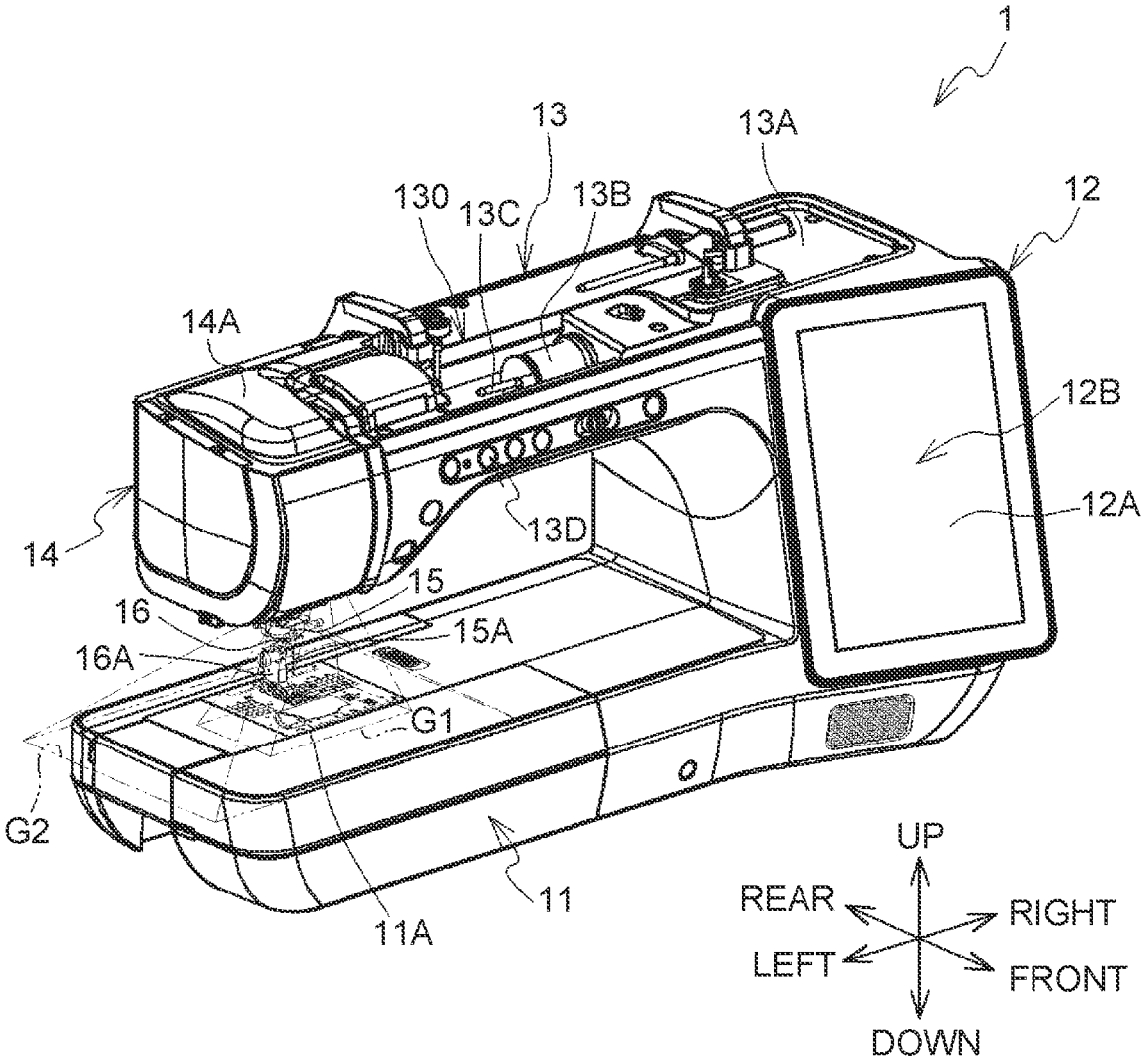
FIG. 1 is a perspective view of a sewing machine with a cover attached, according to an illustrative embodiment of the disclosure.

An illustrative embodiment of the disclosure will now be described with reference to the drawings. An up-down direction, a lower left direction, an upper right direction, an upper left direction, and a lower right direction of the page of FIG. 1 are respectively defined as an up-down direction, a left direction, a right direction, a rear direction, and a front direction of a sewing machine 1. Longitudinal directions of a bed 11 and a horizontal arm 13 correspond to a left-right direction of the sewing machine 1. A side on which an upright arm 12 is disposed is a right side of the sewing machine 1. An extending direction of the upright arm 12 corresponds to the up-down direction of the sewing machine 1.

Overall Structure of Sewing Machine 1

As shown in FIG. 1, the sewing machine 1 includes the bed 11, the upright arm 12, and the horizontal arm 13. The bed 11 extends in the left-right direction as a base of the sewing machine 1. The upright arm 12 extends upward from a right end of the bed 11. The horizontal arm 13 extends from an upper end of the upright arm 12 leftward in the left-right direction which is parallel to the bed 11 and corresponds to a first direction. The horizontal arm 13 includes a head 14 at its left end.

The bed 11 includes a feed mechanism 17 and a shuttle mechanism (not shown). The feed mechanism 17 includes a feed dog 17A. The feed mechanism drives the feed dog 17A to feed a workpiece by a predetermined feed amount in the front-rear direction which corresponds to a third direction. A user faces the sewing machine 1 from a front side of a workpiece in its feed direction. The shuttle mechanism includes a shuttle. The shuttle mechanism drives the shuttle to entangle an upper thread with a lower thread. The feed dog 17A and the shuttle are disposed below a needle plate 11A on an upper surface of the bed 11.

The upright arm 12 includes, at its front, a liquid crystal display 12A and a touchscreen 12B disposed in portrait orientation. The liquid crystal display 12A displays thereon messages and the like necessary for sewing operation. The touchscreen 12B is disposed on a front surface of the liquid crystal display 12A. Upon selection of an item displayed on the liquid crystal display 12A by a user with a finger or an exclusive stylus, the touchscreen 12B detects a selected position. The user is allowed to enter various instructions, via the touchscreen 12B, in the sewing machine 1.

The horizontal arm 13 includes, on its front surface, buttons 13D. The buttons 13D include a start/stop button for instructing start/stop of sewing operation. Pressing the buttons 13D drives synchronously elements including the shuttle mechanism, the feed mechanism 17, a needle bar mechanism 14B, a presser foot mechanism 14C, and a take-up mechanism 14D, which will be described later. Consequently, a stich is formed in a workpiece.

An openable cover is disposed at an upper portion of the horizontal arm 13. The cover is omitted from FIGS. 1 and 2A. The horizontal arm 13 includes a spool storage 130 defined on a surface (referred to as an "upper surface 13A") to be exposed when the cover is open. The spool storage 130 accommodates a spool 13B with an upper thread wound thereon. The spool storage 130 includes, on its right inner wall surface, a spool pin 13C. The spool 13B is attached to the sewing machine 1 with the spool pin 13C inserted into a hole of the spool 13B.

Figure 2A:
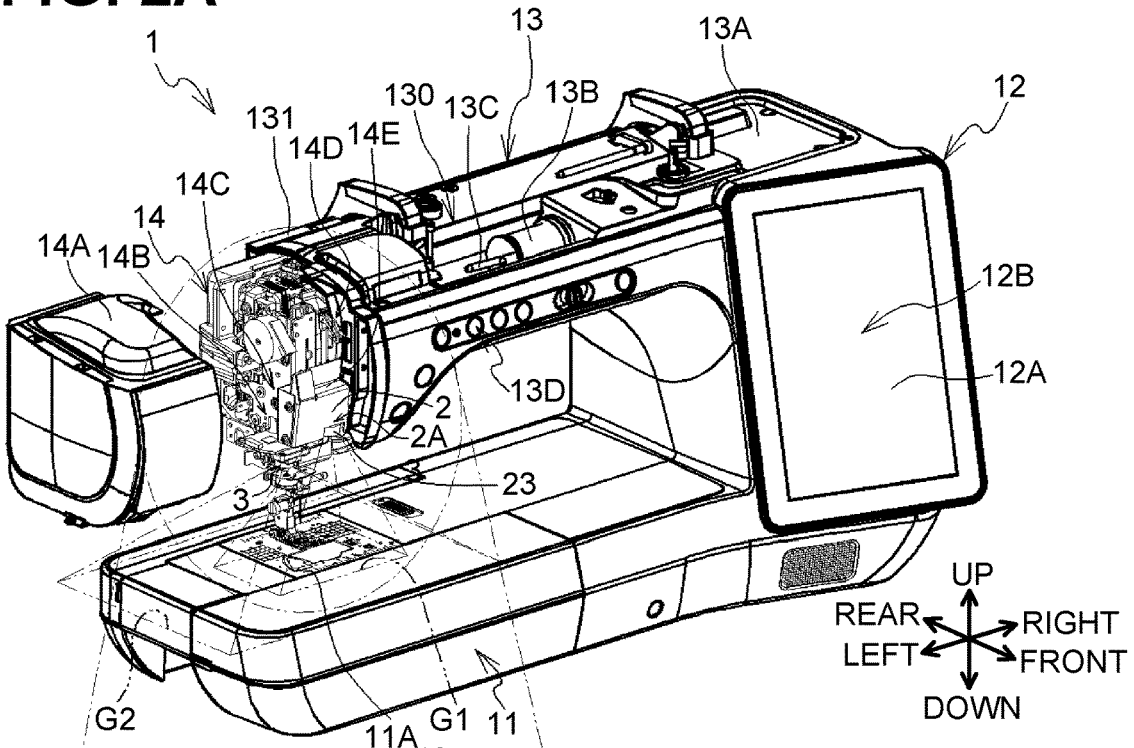
FIG. 2A is a perspective view of the sewing machine from which the cover is removed.
Figure 2A:
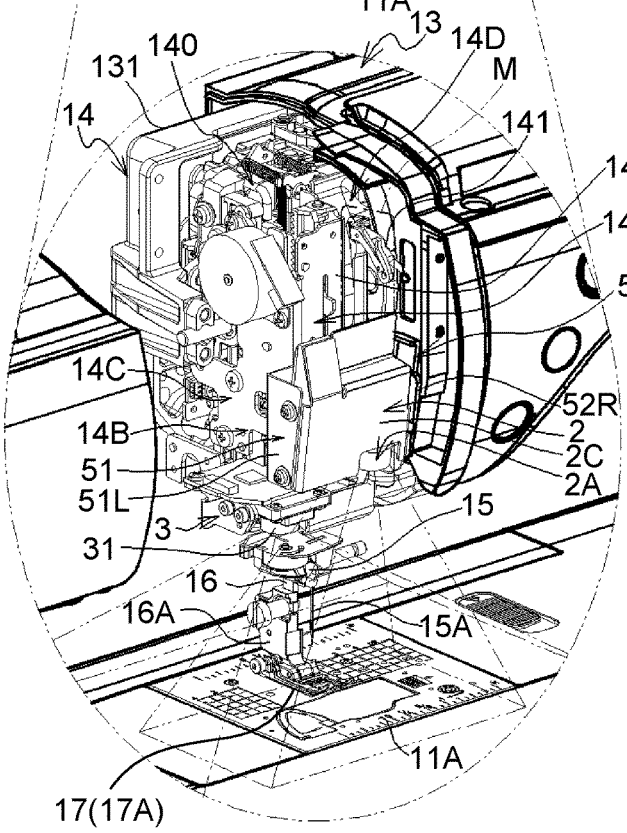
Figure 2B:
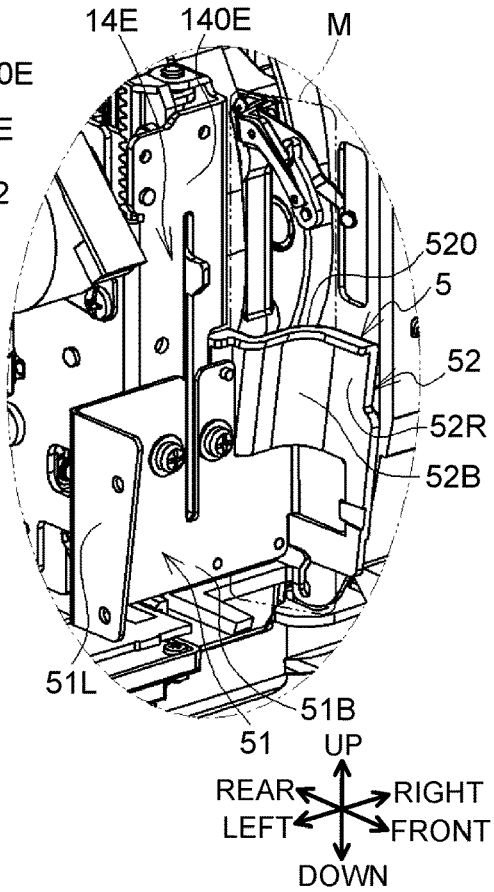
FIG. 2B is a perspective view of a holder for a projector module in the sewing machine.
Figure 3:
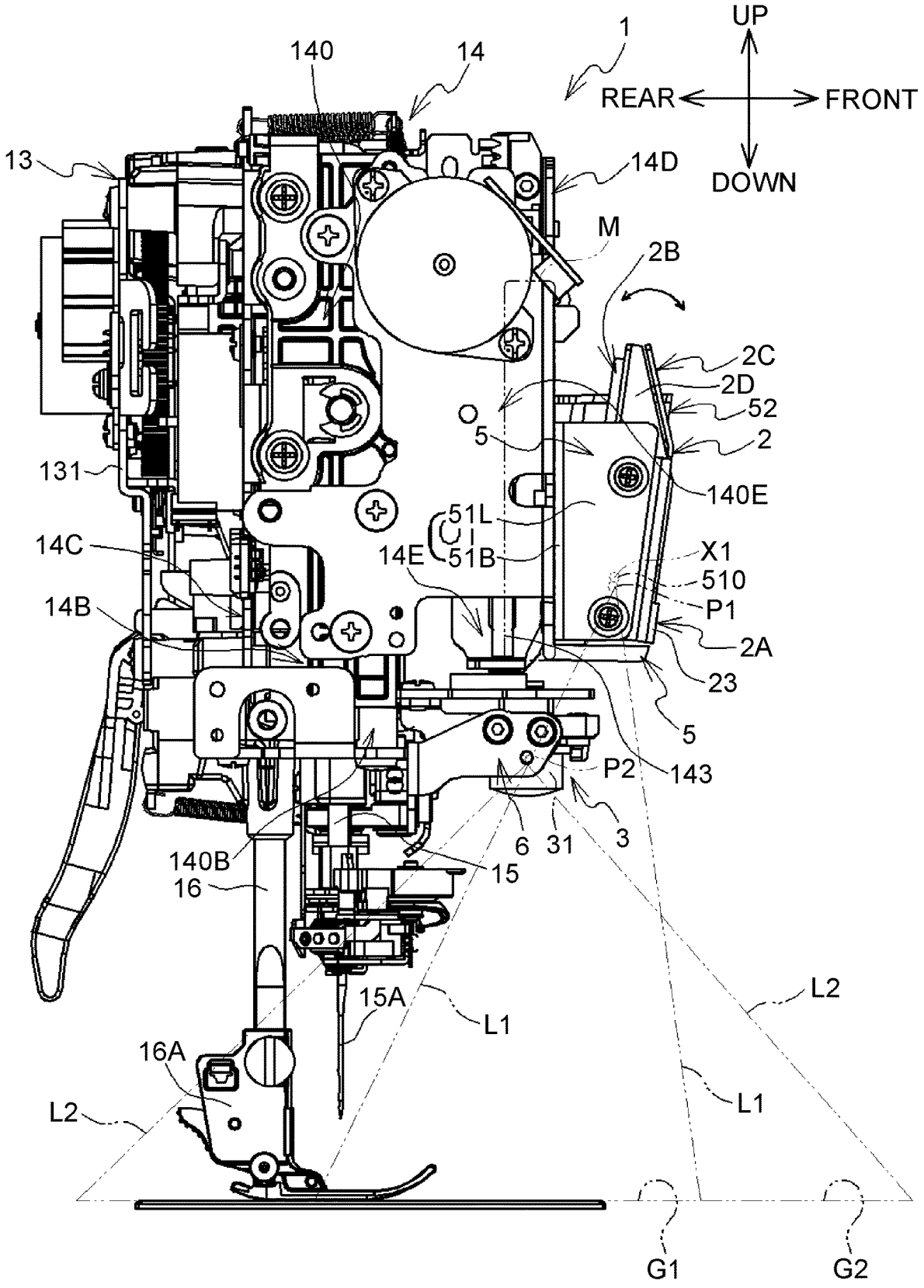
FIG. 3 is a left side view of the sewing machine from which the cover is removed.

As shown in FIGS. 2A and 3, the horizontal arm 13 is supported, via a support 131 in the vicinity of its rear end, by the upright arm 12. The support 131 has a plate shape elongated in the left-right direction and is orthogonal to the front-rear direction. The support 131 may be made of metal. As shown in FIG. 3, the head 14 supports therein a needle bar 15 and a presser bar 16 which extend in the up-down direction corresponding to a second direction. Lower ends of the needle bar 15 and the presser bar 16 protrude downward from a lower end of the head 14. A needle 15A is removably attached to a lower end of the needle bar 15. A presser foot 16A is removably attached to a lower end of the presser bar 16. The needle bar mechanism 14B, the presser foot mechanism 14C, the take-up mechanism 14D, a threading mechanism 14E, a projector module 2, and a camera 3, which will be described later, are disposed at the head 14. As shown in FIG. 2, a removable cover 14A is further disposed at the head 14. The cover 14A, when attached (refer to FIG. 1), covers the needle bar mechanism 14B, the presser foot mechanism 14C, the take-up mechanism 14D, the threading mechanism 14E, the projector module 2, and the camera 3 (refer to FIG. 3).

As shown in FIG. 3, the presser foot mechanism 14C moves the presser bar 16 reciprocally in the up-down direction. This moves the presser foot 16A held by the presser bar 16 reciprocally in the up-down direction. The presser foot 16A cooperates with the feed dog 17A to feed a workpiece in the front-rear direction. The needle bar mechanism 14B moves the needle bar 15 reciprocally in the up-down direction. This moves the needle 15A held by the needle bar 15 reciprocally in the up-down direction. The shuttle entangles an upper thread held by the needle 15A with a lower thread, thereby forming a stitch in a workpiece.

Figure 4:
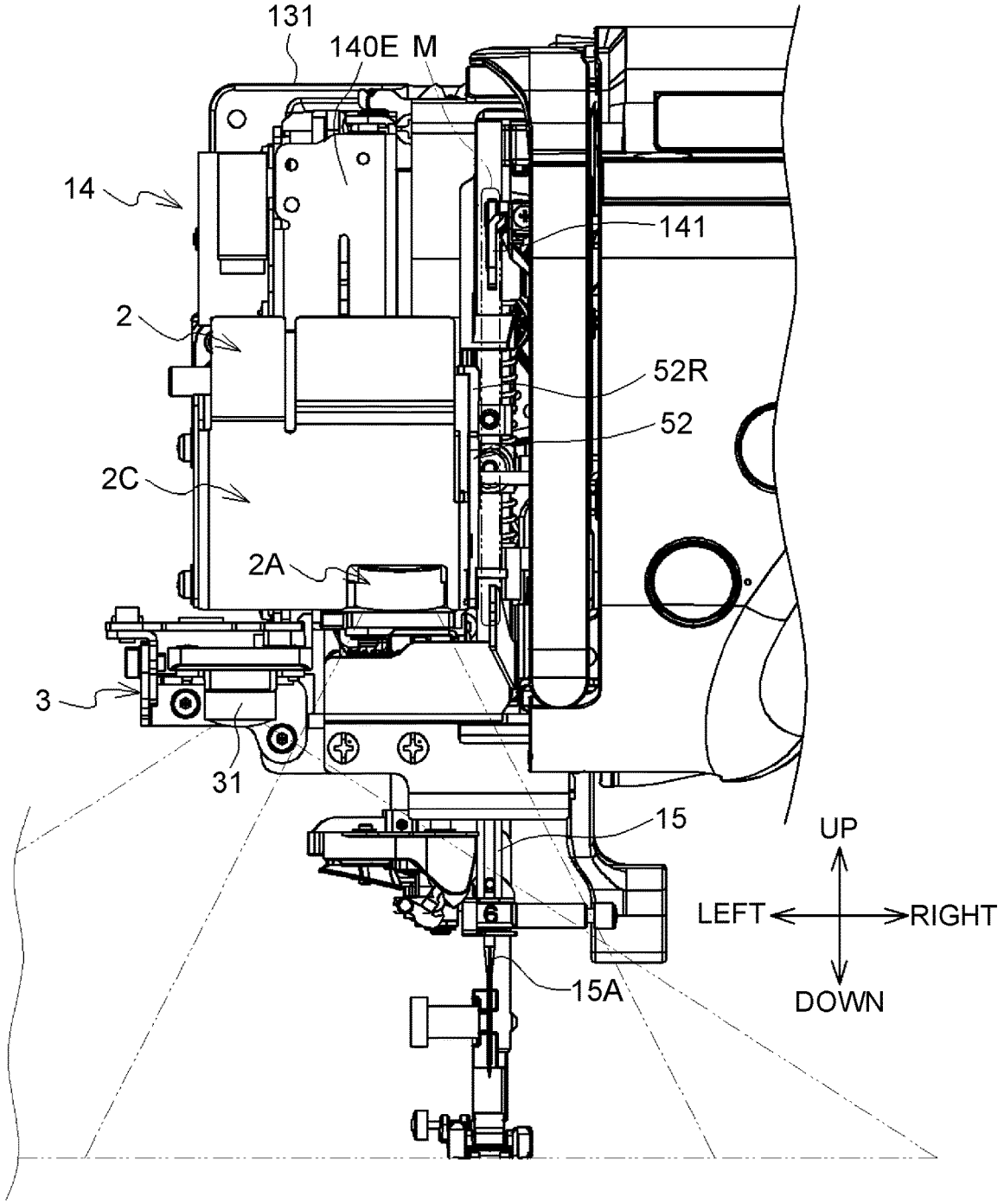
FIG. 4 is a front view of the sewing machine from which the cover is removed.

As shown in FIG. 2A, the take-up mechanism 14D includes a take-up unit 141 having a hole through which an upper thread passes. As shown in FIG. 4, the take-up unit 141 overlaps the needle bar 15 in the front-rear direction. As shown in FIG. 3, the take-up unit 141 is disposed further to the front than the needle bar 15. The take-up mechanism 14D moves the take-up unit 141 reciprocally in the up-down direction. This enables the take-up unit 141 to pull up an upper thread to adjust the position of a knot of upper and lower threads. As shown in FIGS. 2A, 3, and 4, the take-up unit 141 moves reciprocally in the up-down direction to pass through a predetermined range which is referred to as a "moving range M". The take-up unit 141 is reciprocally movable within the moving range M in the up-down direction. The moving range M extends in the up-down direction on a right end of the head 14. The moving range M has the same size in the up-down direction as a movable range in the up-down direction of the take-up unit 141, and has the same size in the left-right direction as the size in the left-right direction of the take-up unit 141.

The threading mechanism 14E includes a knob 143. The knob 143 has a rod shape. The knob 143 is supported so as to be movable in the up-down direction and rotatable about an axis extending in the up-down direction. Rotating the knob 143 moved down allows an upper thread to be passed through an eye of the needle 15A.

A frame 140, which may be made of metal, supports the needle bar mechanism 14B, the presser foot mechanism 14C, the take-up mechanism 14D, and the threading mechanism 14E. The frame 140 is connected to a front surface of the support 131. The support 131 supports, via the frame 140, the needle bar mechanism 14B, the presser foot mechanism 14C, the take-up mechanism 14D, and the threading mechanism 14E.

Projector Module 2

Figure 5:
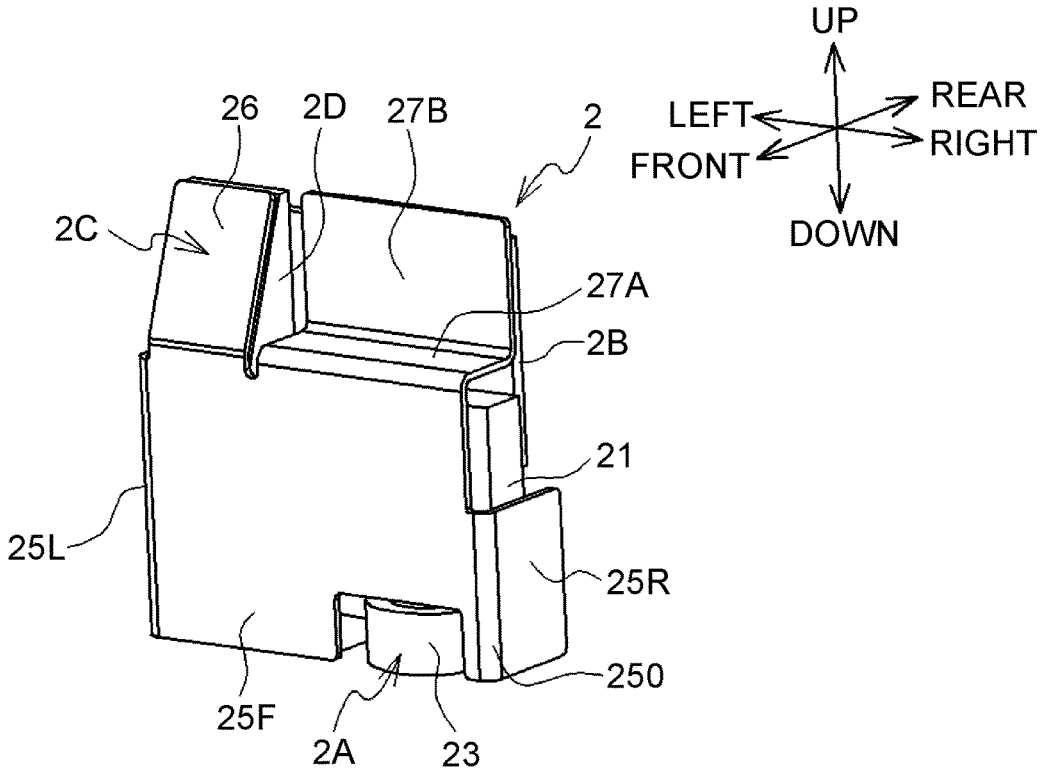
FIG. 5 is a perspective view of the projector module when viewed from the front.
Figure 6:
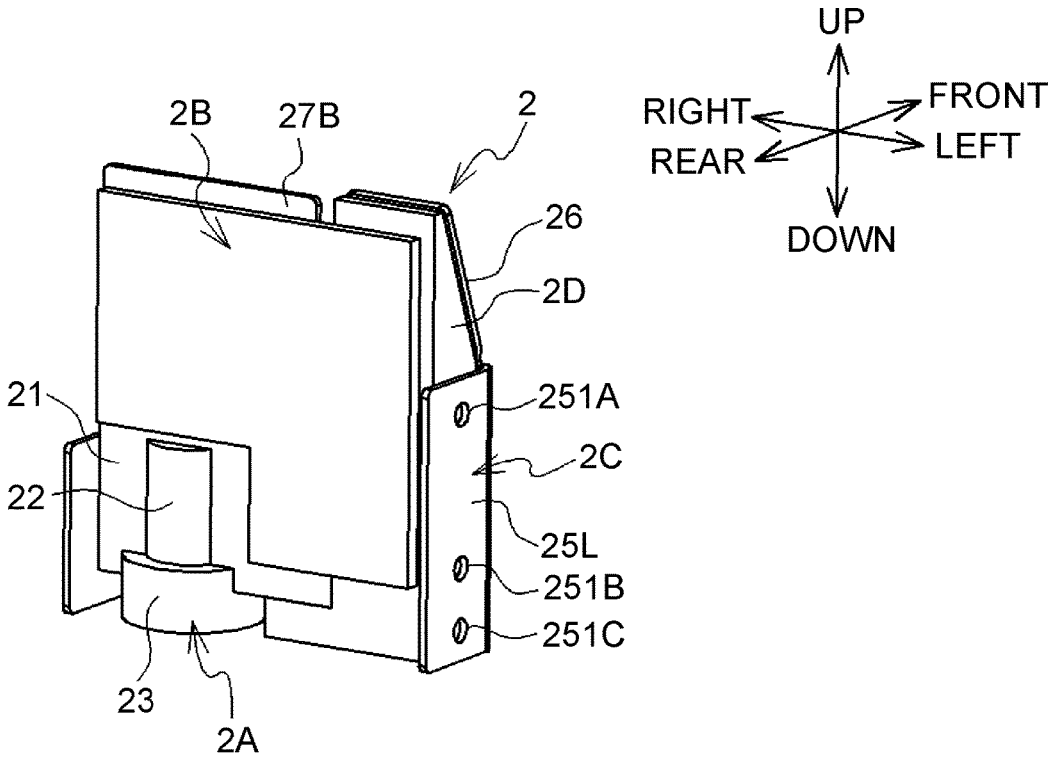
FIG. 6 is a perspective view of the projector module when viewed from the rear.

As shown in FIG. 3, the projector module 2 is disposed on a front surface of a threading frame 140E which belongs to the frame 140 and supports the threading mechanism 14E. The projector module 2 is attached to a holder 5 (described later) fixed to the threading frame 140E, and thus is supported, via the holder 5, by the threading frame 140E. As shown in FIGS. 5 and 6, the projector module 2 includes a projector 2A, a control board 2B, a cover 2C, and a heat absorber 2D.

Figure 7:
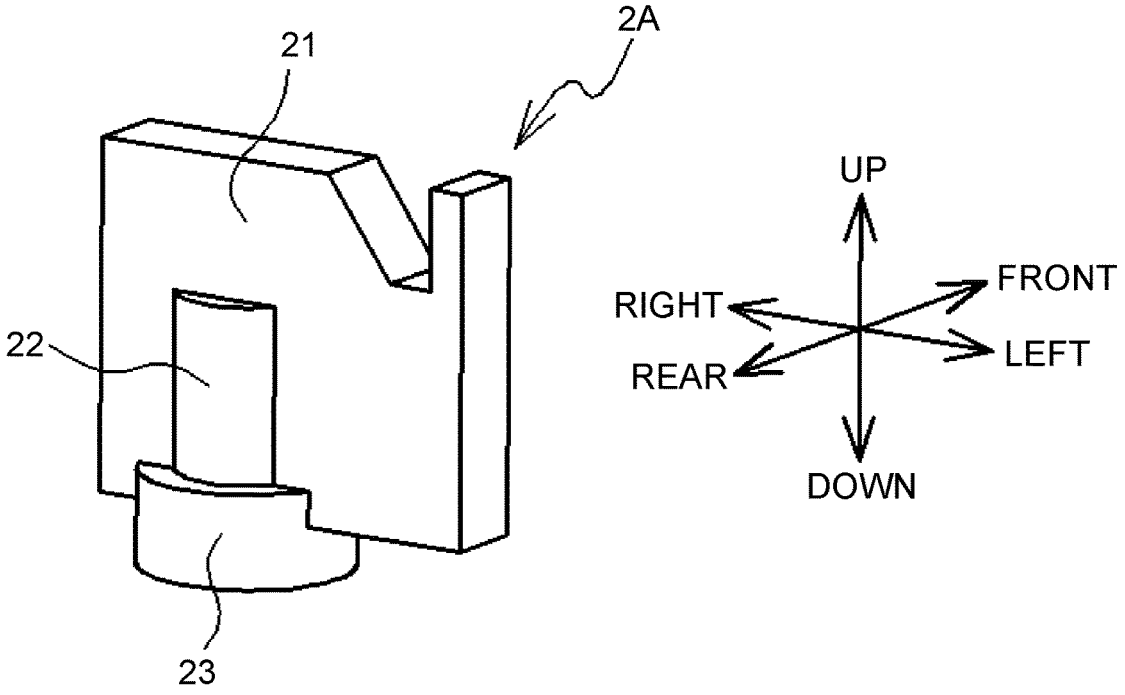
FIG. 7 is a perspective view of a projector of the projector module.

The projector 2A projects a projection image toward the bed 11 (refer to FIGS. 1 to 3). As shown in FIG. 4, the projector 2A is disposed to the left of the moving range M of the take-up unit 141 in the left-right direction. As shown in FIG. 3, the projector 2A is disposed further to the front than the moving range M of the take-up unit 141 in the front-rear direction. As shown in FIG. 7, the projector 2A includes a generator 21, a light guide 22, and a first lens 23.

The generator 21 is plate-shaped and orthogonal to the front-rear direction. The generator 21 includes a reflective display device, a lamp, a mirror, and a prism. The generator 21 generates image light of a projection image by projecting light from the lamp onto an image displayed on the reflective display device. The generator 21 emits the generated image light toward the light guide 22. The generator 21 is not limited to the reflective display device and may be a display device operating by another method. For example, the generator 21 may be a transmissive display device, a laser light source, or a self-luminous device.

Figure 8:
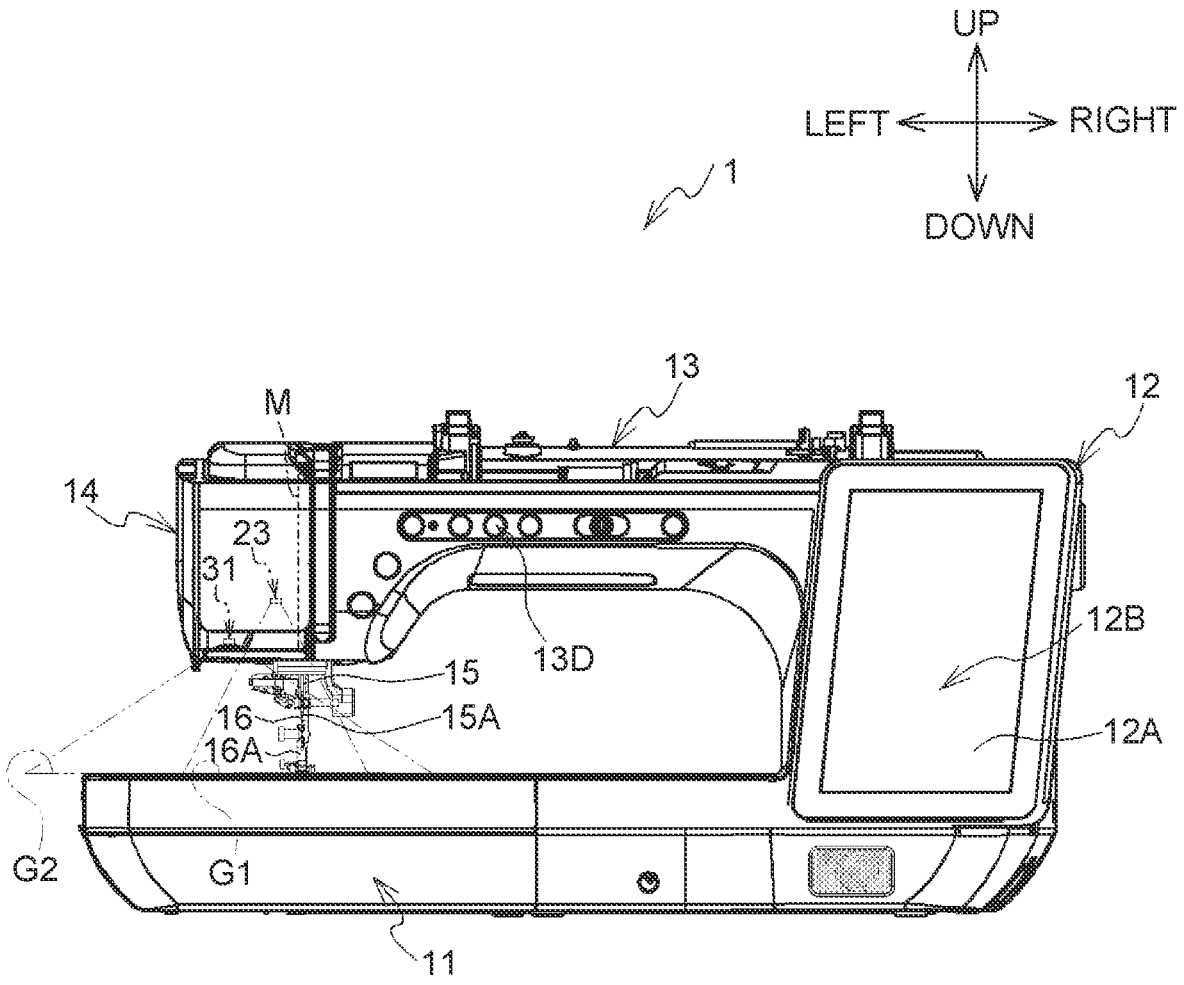
FIG. 8 is a front view of the sewing machine.
Figure 9:
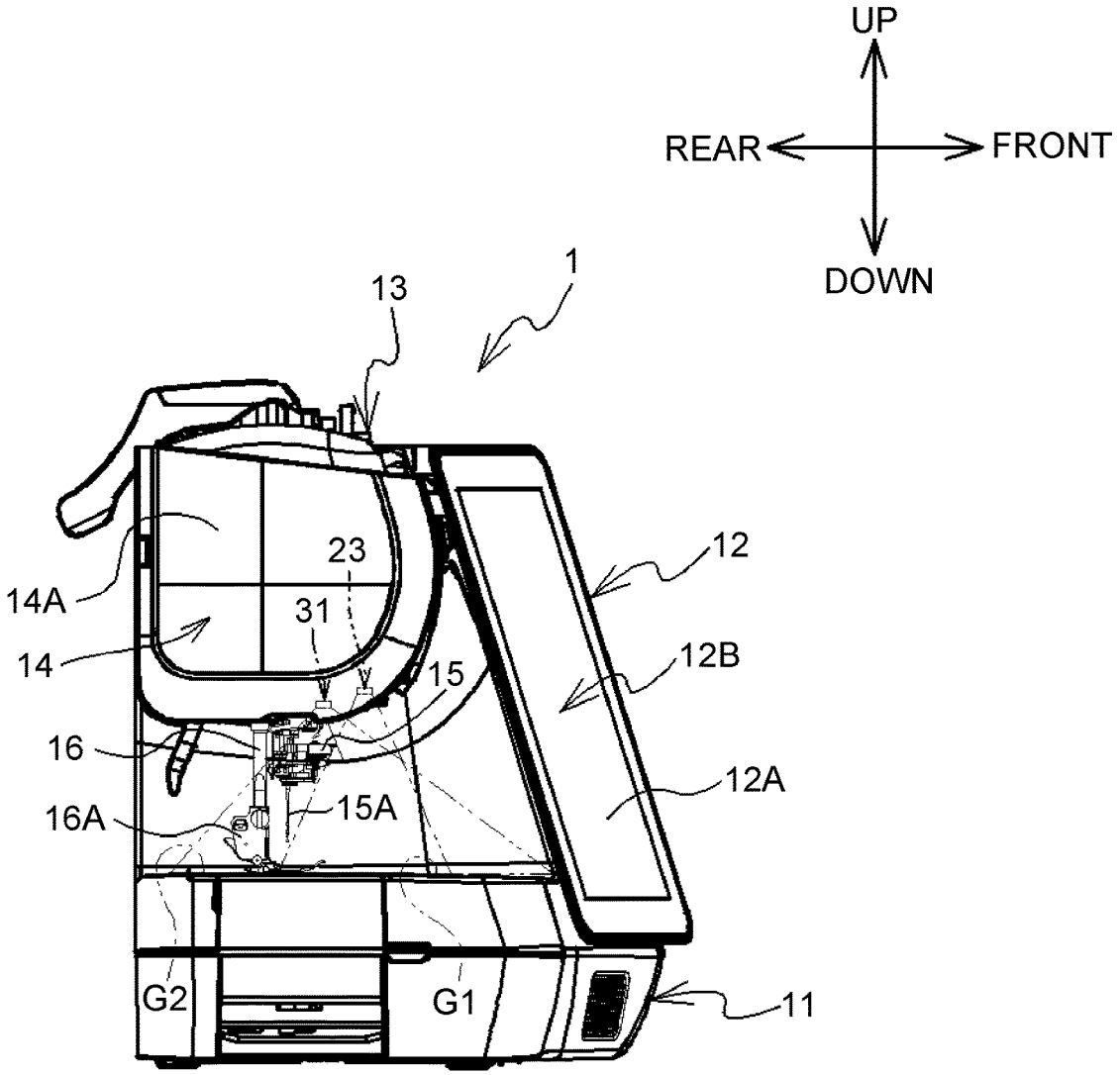
FIG. 9 is a left side view of the sewing machine with the cover attached.

The light guide 22 is cylindrical and extends in the up-down direction. The light guide 22 guides the image light generated by the generator 21 to the first lens 23 at its lower end. The image light guided by the light guide 22 is emitted toward the bed 11 via the first lens 23. As shown in FIG. 2A, a projection area of a projection image projected by emission of the image light from the first lens 23 is referred to as a "projection area G1". As shown in FIG. 3, a plurality of first straight lines L1 are defined to extend from the first lens 23 toward the generator 21 (refer to FIG. 7) along an emission direction of the image light. In this case, the plurality of first straight lines L1 intersect at a first intersection P1. Although FIG. 3 shows only first straight lines L1 defined to extend along the emission direction of an outer edge of the image light, actually a plurality of first straight lines (not shown) exist to extend along a number of beams of the image light emitted over the entire projection area G1. As shown in FIG. 8, the first lens 23 is disposed further to the left than the needle bar 15 in the left-right direction. The left is one side of a thing (e.g., the horizontal arm 13) in the first direction. As shown in FIG. 9, the first lens 23 is disposed further to the front than the needle bar 15 in the front-rear direction. The front is one side of a thing (e.g., the head 14) in the third direction.

As shown in FIG. 6, the control board 2B is disposed on a rear side of the generator 21 of the projector 2A. The control board 2B is orthogonal to the front-rear direction. A driver element is mounted on the control board 2B. The driver element controls the projector 2A to cause the generator 21 to generate image light.

As shown in FIG. 5, the cover 2C has a bent plate shape. The cover 2C may be made of metal. The cover 2C includes plate portions 25F, 25L, 25R, 26, 27A, and 27B. The plate portion 25F is substantially square and orthogonal to the front-rear direction. The plate portion 25F faces a front side of the generator 21 of the projector 2A. The plate portion 25L extends rearward from a left end of the plate portion 25F. As shown in FIG. 6, the plate portion 25L has through-holes 251A, 251B, and 251C. The through-holes 251A, 251B, and 251C are arranged downward in this order. As shown in FIG. 5, the plate portion 25R extends rearward from a lower portion offset from a center in the up-down direction of a right end of the plate portion 25F. A connecting portion 250 of the plate portions 25F and 25R is curved. The plate portion 26 extends obliquely toward the upper rear from a left portion offset from a center in the left-right direction of an upper end of the plate portion 25F. The plate portion 27A extends rearward from a portion of the upper end of the plate portion 25F, other than a portion where the plate portion 26 extends. The plate portion 27B extends upward from a rear end of the plate portion 27A.

As shown in FIGS. 5 and 6, the heat absorber 2D is disposed between the control board 2B and the cover 2C and to the left of the projector 2A. The heat absorber 2D is plate-shaped and has a thickness substantially equal to a distance between the control board 2B and the cover 2C in the front-rear direction. A right end of the heat absorber 2D is in contact with a left end of the generator 21 of the projector 2A. The heat absorber 2D cools the projector 2A by absorbing heat generated by the projector 2A.

Holder 5

Figure 10:
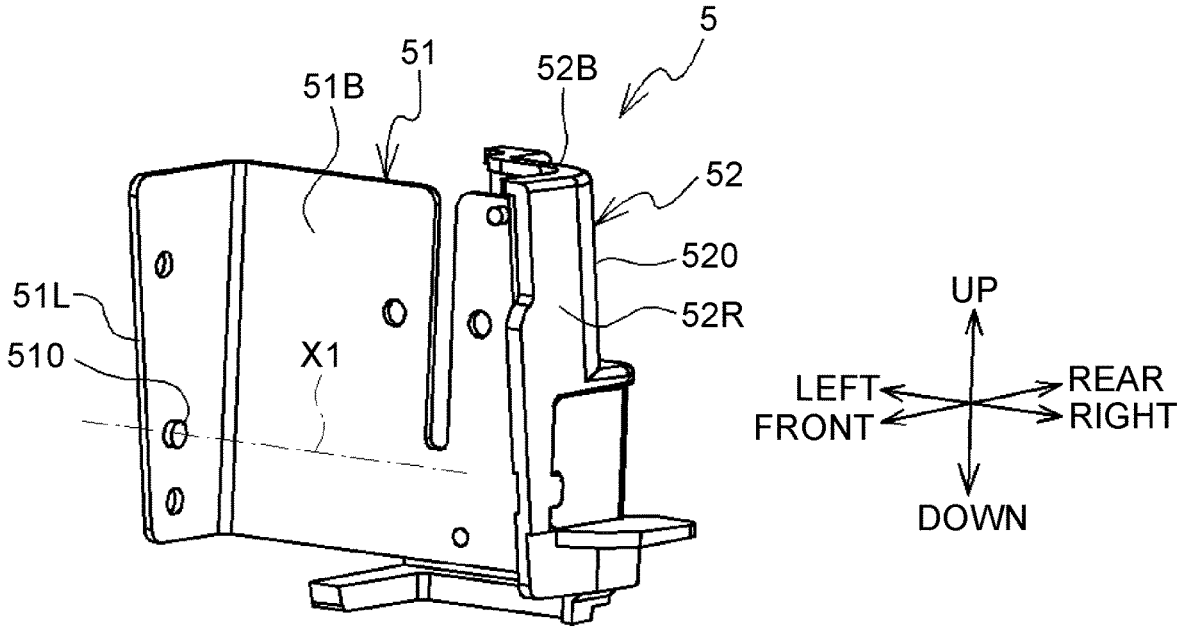
FIG. 10 is a perspective view of the holder for the projector module.

As shown in FIG. 3, the holder 5 is disposed between a front surface of the threading frame 140E of the threading mechanism 14E and the projector module 2. The holder 5 is held by the threading mechanism 14E in a state where the projector module 2 is mounted on the holder 5. The holder 5 movably supports the projector module 2 relative to the threading frame 140E. As shown in FIG. 10, the holder 5 includes a main body 51 and a partition wall 52.

The main body 51 has a bent plate shape. The main body 51 may be made of metal. The main body 51 includes plate portions 51B and 51L. The plate portion 51B is substantially square and orthogonal to the front-rear direction. The plate portion 51B faces, from the rear, a portion of the generator 21 and the control board 2B (refer to FIG. 6) in a state where the projector module 2 is mounted on the holder 5. The plate portion 51L extends frontward from a left end of the plate portion 51B. The plate portion 51L includes, on its right surface, a protrusion 510. The protrusion 510 is cylindrical and extends rightward. The protrusion 510 is inserted from the left into the through-hole 251B (refer to FIG. 6) of the plate portion 25L of the cover 2C in a state where the projector module 2 is mounted on the holder 5.

The holder 5 rotatably supports the projector module 2 mounted thereon about a first axis X1 extending in the left-right direction along the protrusion 510. The emitting direction in which image light is emitted from the first lens 23 of the projector 2A rotates about the first axis X1. As shown in FIG. 3, the first intersection P1 and the first axis X1 are at the substantially same position in the up-down direction, when viewed in a direction (left-right direction) parallel to the first axis X1. More specifically, a distance between the first intersection P1 and the first axis X1 is 5 mm or less when viewed in the direction (left-right direction) parallel to the first axis X1. In FIG. 3, the first axis X1 is located slightly above the first intersection P1.

As shown in FIG. 10, the partition wall 52 is connected to the plate portion 51B of the main body 51. The partition wall 52 may be made of resin. The partition wall 52 includes plate portions 52B and 52R. The plate portions 52B and 52R extend in different directions from each other. The plate portion 52B is connected to a right end of the plate portion 51B of the main body 51. The plate portion 52B is orthogonal to the front-rear direction and faces a rear side of the plate portion 51B. A right end of the plate portion 52B protrudes rightward beyond the right end of the plate portion 51B. The plate portion 52R extends frontward from the right end of the plate portion 52B. As shown in FIG. 4, the plate portion 52R is positioned between the projector 2A and the moving range M in the left-right direction. The partition wall 52 is to the left of and adjacent to the moving range M. As shown in FIG. 2B, the plate portion 52B is disposed further to the front than the moving range M of the take-up unit 141 in the front-rear direction. The plate portion 52B is positioned between the projector 2A and the moving range M in the front-rear direction. As shown in FIG. 10, a connecting portion 520 of the plate portions 52B and 52R is curved.

Camera 3

As shown in FIG. 3, the camera 3 is disposed at a lower portion of the head 14 and, more specifically, on a front surface of a needle bar frame 140B which belongs to the frame 140 and supports the needle bar mechanism 14B. The camera 3 is mounted on the holder 6 (described later) fixed to the needle bar frame 140B. Thus, the camera 3 is supported, via the holder 6, by the needle bar frame 140B. The camera 3 captures a photographing target placed below the head 14. One example of photographing targets is a projection image projected on a workpiece.

Figure 11:
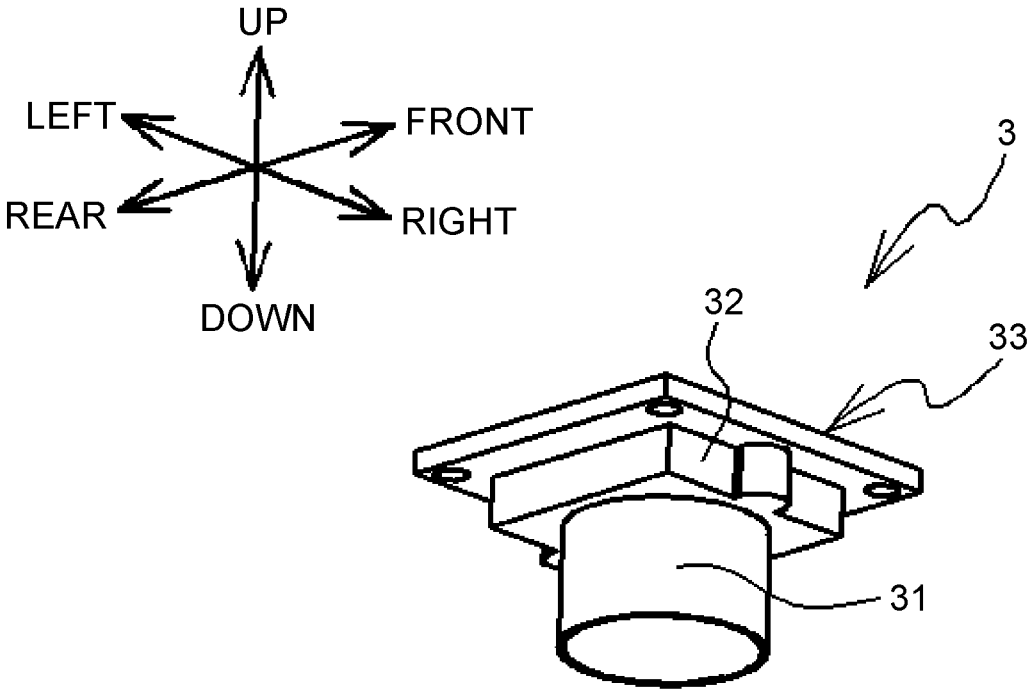
FIG. 11 is a perspective view of a camera of the sewing machine.

As shown in FIG. 11, the camera 3 includes a second lens 31, a lens holder 32, and a detector 33. Light reflected by the photographing target is incident on the second lens 31. The second lens 31 guides the incident reflected light to the detector 33. The lens holder 32 is disposed at an upper end of the second lens 31 and holds the second lens 31 at the detector 33 (described later). The lens holder 32 allows focal adjustment by the second lens 31. The detector 33 is disposed above the lens holder 32. The detector 33 may be a complimentary metal-oxide semiconductor (CMOS)

image sensor. The detector 33 detects reflected light guided by the second lens 31. Thus, a photographing target below the second lens 31 is captured. The detector 33 is not limited to the CMOS image sensor and may be an image sensor operating by another method. For example, the detector 33 may be a charged coupled device (CCD) image sensor. As shown in FIG. 2A, a photographing area of a photographing target captured by the camera 3 is referred to as a "photographing area G2". The photographing area G2 includes the projection area G1 of the projector 2A.

As shown in FIG. 8, the second lens 31 of the camera 3 is disposed further to the left than the needle bar 15 in the left-right direction. The first lens 23 of the projector 2A is disposed further to the right than the second lens 31 of the camera 3 in the left-right direction. As shown in FIG. 9, the second lens 31 of the camera 3 is disposed further to the front than the needle bar 15 in the front-rear direction. The first lens 23 of the projector 2A is disposed further to the front than the second lens 31 of the camera 3 in the front-rear direction. As shown in FIGS. 8 and 9, the first lens 23 of the projector 2A is disposed at an upper position than the second lens 31 of the camera 3 in the up-down direction. As shown in FIG. 3, a plurality of second straight lines L2 are defined to extend from the second lens 31 toward the detector 33 (refer to FIG. 11) along an incident direction of reflected light. In this case, the plurality of second straight lines L2 intersect at a second intersection P2. Although in FIG. 3 shows only second straight lines L2 defined to extend along the incident direction of an outer edge of the reflected light, actually a plurality of second straight lines (not shown) exist to extend along a number of beams of the reflected light incident from the entire photographing area G2.

Holder 6

Figure 12:
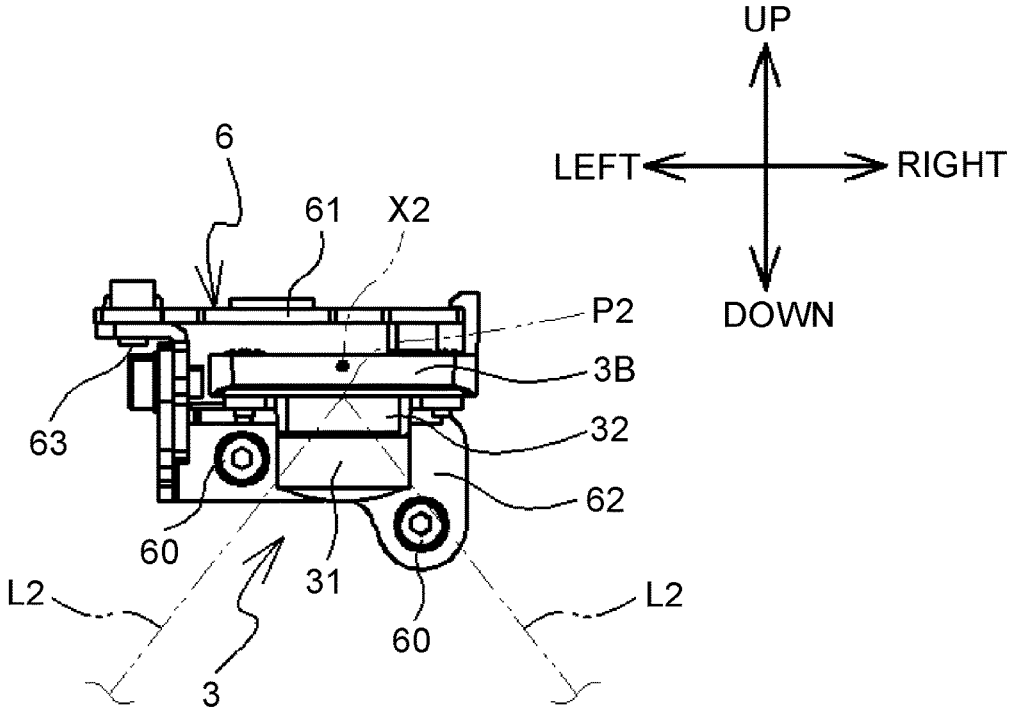
FIG. 12 is a front view of the camera and a holder for the camera.
Figure 13:
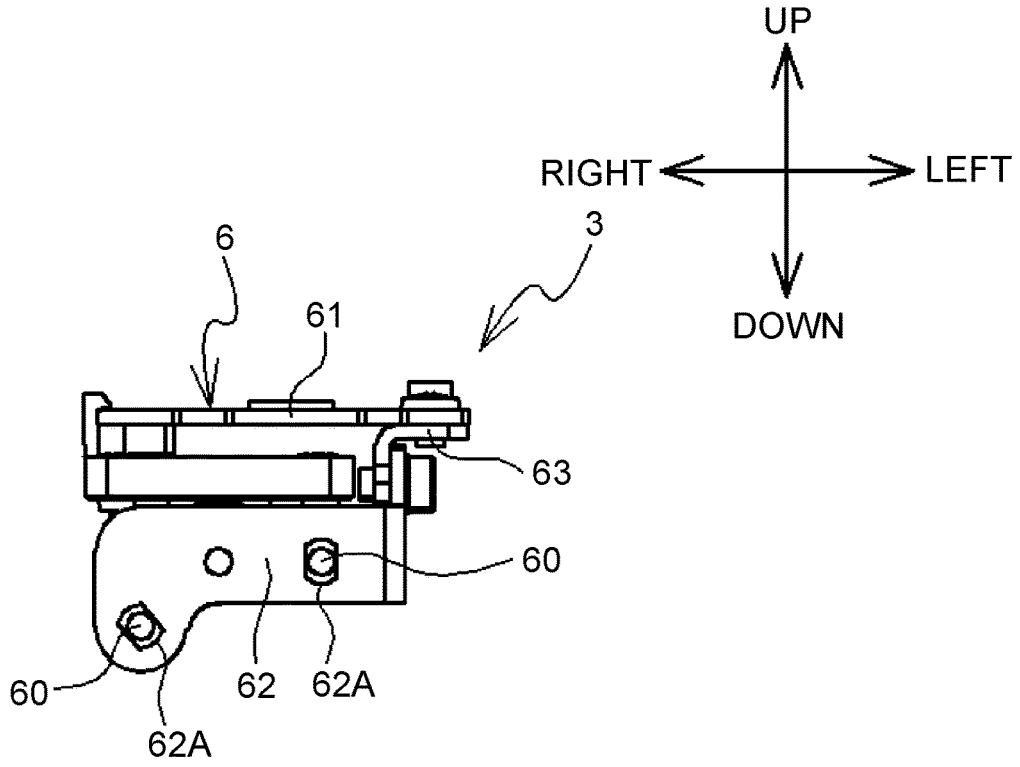
FIG. 13 is a rear view of the camera and the holder for the camera.

As shown in FIG. 3, the holder 6 is disposed between the camera 3 and a front surface of the needle bar frame 140B of the needle bar mechanism 14B. The holder 6 is held by the needle bar mechanism 14B and the head 14, via the needle bar frame 140B, in a state where the camera 3 is mounted on the holder 6. The holder 6 movably supports the camera 3 relative to the needle bar frame 140B. As shown in FIGS. 12 and 13, the holder 6 includes a relay board 61 and plate portions 62, and 63.

The relay board 61 receives a signal output from the detector 33 of the camera 3, converts the signal to a signal detectable by a controller (not shown) of the sewing machine 1, and outputs the converted signal. The relay board 61 is orthogonal to the up-down direction. The detector 33 of the camera 3 is held below the relay board 61. The position of the holder 6 in the left-right direction relative to the needle bar frame 140B is adjustable by the plate portion 62. The plate portion 62 has a substantially rectangular shape elongated in the left-right direction and is orthogonal to the front-rear direction. The plate portion 62 extends downward from a rear end of the relay board 61. The position of the holder 6 in the front-rear direction relative to the needle bar frame 140B is adjustable by the plate portion 63. The plate portion 63 has a substantially rectangular shape elongated in the front-rear direction and is orthogonal to the left-right direction. The plate portion 63 extends downward from a left end of the relay board 61.

As shown in FIG. 13, the plate portion 62 has two slots 62A. As shown in FIG. 12, two screws 60 are inserted in the respective two slots 62A (refer to FIG. 13). The two screws 60 are screwed in the head 14. The two screws 60 hold the holder 6 at the head 14.

The holder 6 is rotatably supported by the needle bar frame 140B in a range in which the two screws 60 relatively move along the respective slots 62A. As shown in FIG. 12, in response to rotation of the holder 6, the incident direction of reflected light incident on the second lens 31 of the camera 3 rotates about a second axis X2 extending in the front-rear direction. The second intersection P2 of the camera 3 and the second axis X2 are at the substantially same position in the up-down direction, when viewed in a direction (front-rear direction) parallel to the second axis X2. More specifically, a distance between the second intersection P2 and the second axis X2 is 5 mm or less when viewed in the direction (front-rear direction) parallel to the second axis X2. In FIG. 12, the second axis X2 is located slightly above the second intersection P2.

Usage Examples of Projector Module 2 and Camera 3

For example, the projector 2A of the projector module 2 emits image light of an image representing an embroidery pattern. The image light is projected on a workpiece placed on the bed 11. This allows a user to confirm, prior to execution of sewing, a state in which an embroidery pattern is sewn on the workpiece. Also, for example, before shipment of the sewing machine 1, the projector 2A projects a predetermined calibration pattern (e.g., grid lines arranged in a grid pattern). The camera 3 captures the calibration pattern. The controller (not shown) of the sewing machine 1 detects a distortion amount of the captured image and stores it in a memory (not shown). When the sewing machine 1 is used after shipment and projects image light of an image representing an embroidery pattern, the controller adjusts the image light emitted from the projector 2A to correct distortion by the distortion amount stored in the memory. This enables the sewing machine 1 to project image light of an image without distortion on a workpiece. The usage examples of the projector module 2 and the camera 3 are not limited to the above, and they can be used for various other purposes.

Effects of Illustrative Embodiment

In the sewing machine 1, the first lens 23 of the projector 2A and the second lens 31 of the camera 3 are disposed to the left of the needle bar 15 at the head 14. In this case, the sewing machine 1 provides a wide space surrounded by the upright arm 12, the horizontal arm 13, the needle bar 14, and the bed 11. Thus, the sewing machine 1 maintains operability for a user in this space. This may reduce, in the sewing machine 1, the possibility that the projector 2A and the camera 3 interfere with the take-up unit 141.

In the sewing machine 1, the first lens 23 of the projector 2A and the second lens 31 of the camera 3 are disposed further to the front than the needle bar 15 at the head 14. This may reduce, in the sewing machine 1, the possibility that an upper thread guided by the take-up unit 141 is caught by the projector 2A and the camera 3. The first lens 23 of the projector 2A is disposed further to the front than the needle bar 15. This may reduce the possibility that a shadow of the needle bar 15 caused by emitted image light hinders sewing operation by a user. Reflection of the emitted image light toward the user's visual field may also be reduced and thus operability for the user may be maintained. The second lens 31 of the camera 3 disposed further to the front than the needle bar 15 is enabled to properly capture a photographing target. For example, the camera 3 is enabled to properly capture a projection image projected by the projector 2A.

In the sewing machine 1, the first lens 23 of the projector 2A and the second lens 31 of the camera 3 are disposed to the left of and further to the front than the needle bar 15 at the head 14. In this case, the projector 2A and the camera 3 are readily exposed by removing the cover 14A from the head 14 of the sewing machine 1. Thus, the sewing machine 1 provides a user with ease of maintenance of the projector 2A and the camera 3.

As described above, while maintaining operability for a user, the sewing machine 1 enables the projector 2A to properly project a projection image and enables the camera 3 to properly capture a photographing target.

The first lens 23 of the projector 2A is disposed to the right of the second lens 31 of the camera 3. In this case, in the sewing machine 1, the first lens 23 of the projector 2A is allowed to be disposed at a position relatively closer to the needle bar 15. This enhances, in the sewing machine 1, positional accuracy of a projection image projected in the vicinity of a needle drop point. Accordingly, for example when projecting an embroidery pattern as a projection image, the projector 2A is enabled to accurately project the embroidery pattern onto a portion of a workpiece where sewing is actually performed. Further, in the sewing machine 1, the camera 3 may be prevented from even partially entering the emission position of image light emitted by the projector 2A. This may reduce, in the sewing machine 1, the possibility that a portion of the projection image becomes invisible behind the camera 3 (i.e., so-called vignetting occurs).

The first lens 23 of the projector 2A is disposed further to the front than the second lens 31 of the camera 3. In this case, the camera 3 may be prevented from extending to the front relative to the head 14. This may reduce, in the sewing machine 1, the possibility that the camera 3 enters a user's visual field in the vicinity of the needle drop point to hinder operation by the user.

The first lens 23 of the projector 2A is disposed farther from the bed 11 in the up-down direction than the second lens 31 of the camera 3. This may readily widen, in the sewing machine 1, the projection range of a projection image while reducing the possibility that the camera 3 enters a user's visual field in the vicinity of the needle drop point during sewing operation. In the sewing machine 1, the second lens 31 of the camera 3 is allowed to be disposed relatively close to the bed 11. In this case, the needle bar 15 and the like may be prevented from entering the photographing range to be captured by the camera 3, thereby reducing the possibility that an unwanted object appears in the captured image.

The projector 2A includes the generator 21. Image light generated by the generator 21 is emitted toward the bed 11 via the first lens 23. The holder 5 rotates, about the first axis X1, the emission direction in which the image light is emitted from the first lens 23. The first axis X1 and the first intersection P1 of a plurality of first straight lines L1 defined to extend from the first lens 23 toward the generator 21 along the emission direction are at the substantially same position. In this case, the projector 2A with a compact structure is enabled to change in a wide range the emission direction of the image light emitted from the first lens 23. Thus, the downsized projector 2A enables the sewing machine 1 to save space.

The camera 3 includes the detector 33. The holder 6 rotates, about the second axis X2, the incident direction in which reflected light is incident on the second lens 31. The detector 33 detects the reflected light incident via the second lens 31. The second axis X2 and the second intersection P2 of a plurality of second straight lines L2 defined to extend from the second lens 31 toward the detector 33 along the incident direction are at the substantially same position. In this case, the camera 3 with a compact structure is enabled to change in a wide range the incident direction of the reflected light incident from the second lens 31. Thus, the downsized camera 3 enables the sewing machine 1 to save space.

The sewing machine 1 includes, at the head 14, the threading mechanism 14E for passing an upper thread through the sewing needle. The projector 2A is fixed, via the holder 5, to the threading frame 140E of the threading mechanism 14E. In this case, heat generated from the projector 2A is transmitted via the holder 5 to the threading frame 140E which dissipates the heat. Thus, the sewing machine 1 realizes dissipation of heat from the projector 2A by the threading frame 140E. In this case, a fan or the like for cooling the projector 2A is not required, thereby eliminating troubles caused by a fan (such as scattering of thread dust and lubricating oil due to the flow of air generated by the fan, clogging or malfunction of the fan). Such smooth heat dissipation allows use of a compact projector 2A. Thus, the downsized projector 2A enables the sewing machine 1 to save space.

The photographing area G2 of the camera 3 includes the projection area G1 of a projection image projected by the projector 2A. In this case, in the sewing machine 1, the camera 3 is enabled to properly capture a projection image projected by the projector 2A.

The sewing machine 1 includes the take-up unit 141. The take-up unit 141 disposed at the head 14 is reciprocally movable within the moving range M in the up-down direction. The holder 5 includes the partition wall 52. The plate portion 52R of the partition wall 52 is positioned between the projector 2A and the moving range M in the left-right direction. In this case, in the sewing machine 1, the plate portion 52B of the partition wall 52 may reduce the possibility that an upper thread guided by the take-up unit 141 is caught by the projector 2A. The connecting portion 520 of the plate portions 52B and 52R of the partition wall 52 is curved. This may reduce, in the sewing machine 1, the possibility that an upper thread is caught by the partition wall 52 itself.

The heat absorber 2D of the projector module 2 contacts the generator 21 of the projector 2A to absorb the heat of the generator 21 and thereby cool the generator 21. The heat of the heat absorber 2D is transmitted to the support 131 which supports the arm 13, via the cover 2C of the projector module 2, the threading frame 140E of the threading mechanism 14E, and the frame 140. In this case, the sewing machine 1 realizes the heat dissipation function of the projector 2A by the heat absorber 2D configured to absorb the heat generated by the projector 2A and transmit the heat to the support 131 via the cover 2C, the threading frame 140E, and the frame 140. Thus, heat dissipation is realized by the support 131 existing in the sewing machine 1 without the need for adding a new structure for heat dissipation. Thus, the sewing machine 1 is enabled to save space while realizing effectively heat dissipation from the projector 2A.

Modifications

The disclosure may not be limited to the above-described illustrative embodiment, and various changes may be applied therein. The sewing machine 1 may include a moving mechanism for moving an embroidery hoop in the front-rear direction and in the left-right direction. The sewing machine 1 may sew an embroidery pattern when the moving mechanism moves a workpiece held by the embroidery hoop in the front-rear direction and in the left-right direction.

The locations of the first lens 23 of the projector 2A and the second lens 31 of the camera 3 may be changed as needed, as long as the first lens 23 and the second lens 31 satisfy the condition that they are disposed to the left of and further to the front than the needle bar 15. For example, the first lens 23 of the projector 2A may be disposed to the left of the second lens 31 of the camera 3. The first lens 23 of the projector 2A may be disposed further to the rear than the second lens 31 of the camera 3. The first lens 23 of the projector 2A may be disposed at a lower position than the second lens 31 of the camera 3. The first lens 23 of the projector 2A and the second lens 31 of the camera 3 may be disposed at the same position.

The projector 2A may emit laser light from a laser light source to generate image light. In this case, the projector 2A may not include the first lens 23 and may have a through-hole instead at a position where the image light is emitted. The projector module 2 may be directly fixed to the threading frame 140E. In this case, the emission direction in which image light is emitted from the projector 2A may be unchangeable.

The camera 3 may not include the second lens 31 and may have a through-hole instead at a position where reflect light is incident. The camera 3 may be directly fixed to the needle bar frame 140B. In this case, the incident direction in which the reflect light is incident on the camera 3 may be unchangeable.

The projector 2A may not be disposed at the threading frame 140E of the threading mechanism 14E. For example, the projector 2A may be disposed at the needle bar frame 140B of the needle bar mechanism 14B, or may be directly disposed at the cover 14A for the head 14. The projector 2A may be disposed at the support 131 of the arm 13. The photographing area G2 of the camera 3 may not include a portion of the projection area G1 of a projection image projected by the projector 2A.

The plate portion 52R of the partition wall 52 may overlap the moving range M of the take-up unit 141 in the left-right direction. The connecting portion 520 of the plate portions 52B and 52R of the partition wall 52 may be angular.

The plate portion 51B of the projector module 2 may be directly fixed to the support 131 of the arm 13. The projector module 2 may not include the heat absorber 2D. A fan may be provided to cool the projector 2A.

Others

The left-right direction is an example of a first direction according to an aspect of the disclosure. The left is an example of one side of a thing in the first direction according to an aspect of the disclosure. The up-down direction is an example of a second direction according to an aspect of the disclosure. The front-rear direction is an example of a third direction according to an aspect of the disclosure. The front is an example of one side of a thing in the third direction according to an aspect of the disclosure. The rear is an example of the other side of the thing in the third direction according to an aspect of the disclosure. The feed mechanism 17 is an example of a feed mechanism according to an aspect of the disclosure. The horizontal arm 13 is an example of an arm according to an aspect of the disclosure. The projector 2A is an example of a projection unit according to an aspect of the disclosure. The first lens 23 is an example of an emitter according to an aspect of the disclosure. The camera 3 is an example of a photographing unit according to an aspect of the disclosure. The second lens 31 is an example of an incident portion according to an aspect of the disclosure. The holder 5 is an example of a first rotation mechanism according to an aspect of the disclosure. The holder 6 is an example of a second rotation mechanism according to an aspect of the disclosure. The cover 2C, the threading frame 140E, and the frame 140 are each an example of a transmitter according to an aspect of the disclosure.

What is claimed is:

1. A sewing machine comprising:

a bed;

an arm extending in a first direction and including, on one side thereof in the first direction, a head;

a needle bar disposed at the head and configured to receive a needle and reciprocally move in a second direction orthogonal to the first direction;

a feed mechanism configured to feed a workpiece, from one side toward the other side of the head, in a third direction orthogonal to the first direction and the second direction;

a projection unit disposed at the head and configured to project a projection image toward the bed, the projection unit including an emitter from which image light of the projection image is emitted;

a photographing unit disposed at the head and configured to capture a photographing target, the photographing unit including an incident portion on which light reflected by the photographing target is incident; and a first rotation mechanism configured to rotate, about a first axis, an emission direction in which the image light is emitted from the emitter of the projection unit, wherein the emitter of the projection unit and the incident portion of the photographing unit are disposed further toward the one side of the arm in the first direction than the needle bar, and further toward the one side of the head in the third direction than the needle bar, wherein the projection unit includes a generator configured to generate the image light, the emitter includes a first lens, and the image light generated by the generator is emitted via the first lens toward the bed, and wherein the first axis and a first intersection of a plurality of first straight lines defined to extend from the first lens toward the generator along beams of the image light emitted in the emission direction are at a substantially same position in the second direction.

2. The sewing machine according to claim 1, wherein the emitter of the projection unit is disposed further toward the other side of the arm in the first direction than the incident portion of the photographing unit.

3. The sewing machine according to claim 1, wherein the emitter of the projection unit is disposed further toward the one side of the head in the third direction than the incident portion of the photographing unit.

4. The sewing machine according to claim 1, wherein the emitter of the projection unit is disposed farther from the bed in the second direction than the incident portion of the photographing unit.

5. A sewing machine comprising:

a bed;

an arm extending in a first direction and including, on one side thereof in the first direction, a head;

a needle bar disposed at the head and configured to receive a needle and reciprocally move in a second direction orthogonal to the first direction;

a feed mechanism configured to feed a workpiece, from one side toward the other side of the head, in a third direction orthogonal to the first direction and the second direction;

a projection unit disposed at the head and configured to project a projection image toward the bed, the projection unit including an emitter from which image light of the projection image is emitted;

a photographing unit disposed at the head and configured to capture a photographing target, the photographing unit including an incident portion on which light reflected by the photographing target is incident; and a second rotation mechanism configured to rotate, about a second axis, an incident direction in which the reflected light is incident on the incident portion of the photographing unit, wherein the emitter of the projection unit and the incident portion of the photographing unit are disposed further toward the one side of the arm in the first direction than the needle bar, and further toward the one side of the head in the third direction than the needle bar, wherein the photographing unit includes a detector configured to detect the reflected light, the incident portion includes a second lens, and the detector is configured to detect the reflected light incident via the second lens, and wherein the second axis and a second intersection of a plurality of second straight lines defined to extend from the second lens toward the detector along beams of the reflected light incident in the incident direction are at a substantially same position in the second direction.

6. The sewing machine according to claim 1, further comprising a threading mechanism disposed at the head and configured to pass a thread through the needle, wherein the projection unit is disposed at the threading mechanism.

7. The sewing machine according to claim 1, wherein the projection image projected by the projection unit is included in a photographing area of the photographing unit.

8. A sewing machine comprising:

a bed;

an arm extending in a first direction and including, on one side thereof in the first direction, a head;

a needle bar disposed at the head and configured to receive a needle and reciprocally move in a second direction orthogonal to the first direction;

a feed mechanism configured to feed a workpiece, from one side toward the other side of the head, in a third direction orthogonal to the first direction and the second direction;

a projection unit disposed at the head and configured to project a projection image toward the bed, the projection unit including an emitter from which image light of the projection image is emitted;

a photographing unit disposed at the head and configured to capture a photographing target, the photographing unit including an incident portion on which light reflected by the photographing target is incident;

a take-up unit disposed at the head and configured to reciprocally move in the second direction within a predetermined moving range; and a partition wall disposed between the projection unit and the moving range in the first direction, wherein the emitter of the projection unit and the incident portion of the photographing unit are disposed further toward the one side of the arm in the first direction than the needle bar, and further toward the one side of the head in the third direction than the needle bar.

9. The sewing machine according to claim 8, wherein the partition wall includes a plurality of plate portions extending in different directions from each other and connected to each other, and a connecting portion of the plurality of the plate portions is curved.

10. A sewing machine comprising:

a bed;

an arm extending in a first direction and including, on one side thereof in the first direction, a head;

a needle bar disposed at the head and configured to receive a needle and reciprocally move in a second direction orthogonal to the first direction;

a feed mechanism configured to feed a workpiece, from one side toward the other side of the head, in a third direction orthogonal to the first direction and the second direction;

a projection unit disposed at the head and configured to project a projection image toward the bed, the projection unit including an emitter from which image light of the projection image is emitted;

a photographing unit disposed at the head and configured to capture a photographing target, the photographing unit including an incident portion on which light reflected by the photographing target is incident;

a heat absorber configured to cool the projection unit by absorbing heat of the projection unit; and a transmitter configured to transmit the heat absorbed by the heat absorber to a support supporting the arm, wherein the emitter of the projection unit and the incident portion of the photographing unit are disposed further toward the one side of the arm in the first direction than the needle bar, and further toward the one side of the head in the third direction than the needle bar.

11. The sewing machine according to claim 5, wherein the emitter of the projection unit is disposed further toward the other side of the arm in the first direction than the incident portion of the photographing unit.

12. The sewing machine according to claim 5, wherein the emitter of the projection unit is disposed further toward the one side of the head in the third direction than the incident portion of the photographing unit.

13. The sewing machine according to claim 5, wherein the emitter of the projection unit is disposed farther from the bed in the second direction than the incident portion of the photographing unit.

14. The sewing machine according to claim 5, further comprising a threading mechanism disposed at the head and configured to pass a thread through the needle, wherein the projection unit is disposed at the threading mechanism.

15. The sewing machine according to claim 5, wherein the projection image projected by the projection unit is included in a photographing area of the photographing unit.

16. The sewing machine according to claim 8, wherein the emitter of the projection unit is disposed further toward the other side of the arm in the first direction than the incident portion of the photographing unit.

17. The sewing machine according to claim 8, wherein the emitter of the projection unit is disposed further toward the one side of the head in the third direction than the incident portion of the photographing unit.

18. The sewing machine according to claim 8, wherein the emitter of the projection unit is disposed farther from the bed in the second direction than the incident portion of the photographing unit.

19. The sewing machine according to claim 8, further comprising a threading mechanism disposed at the head and configured to pass a thread through the needle, wherein the projection unit is disposed at the threading mechanism.

20. The sewing machine according to claim 8, wherein the projection image projected by the projection unit is included in a photographing area of the photographing unit.

21. The sewing machine according to claim 10, wherein the emitter of the projection unit is disposed further toward the other side of the arm in the first direction than the incident portion of the photographing unit.

22. The sewing machine according to claim 10, wherein the emitter of the projection unit is disposed further toward the one side of the head in the third direction than the incident portion of the photographing unit.

23. The sewing machine according to claim 10, wherein the emitter of the projection unit is disposed farther from the bed in the second direction than the incident portion of the photographing unit.

24. The sewing machine according to claim 10, further comprising a threading mechanism disposed at the head and configured to pass a thread through the needle, wherein the projection unit is disposed at the threading mechanism.

25. The sewing machine according to claim 10, wherein the projection image projected by the projection unit is included in a photographing area of the photographing unit.

* * * * *